United States Patent [19]

Nakayama et al.

[11] 4,367,283

[45] Jan. 4, 1983

[54] PHOTOGRAPHIC LIGHT-SENSITIVE MATERIAL WITH THREE SURFACE ACTIVE AGENTS

[75] Inventors: Yasuhiro Nakayama, Fujinomiya; Masakazu Yoneyama; Yasuo Mukunoki, both of Minami-ashigara; Akira Kitada, Fujinomiya; Shinzo Kishimoto, Minami-ashigara, all of Japan

[73] Assignee: Fuji Photo Film Co., Ltd., Kanagawa, Japan

[21] Appl. No.: 277,443

[22] Filed: Jun. 25, 1981

[30] Foreign Application Priority Data

Jun. 25, 1980 [JP] Japan ..... 55/86200

[51] Int. Cl.[3] ..... G03C 1/78; G03C 1/96; G03C 1/38

[52] U.S. Cl. ..... 430/528; 430/529; 430/631; 430/636; 430/637

[58] Field of Search ..... 430/495, 528, 529, 631, 430/636, 637, 539

[56] References Cited

U.S. PATENT DOCUMENTS

| | | | |
|---|---|---|---|
| 3,666,478 | 5/1972 | Groh et al. | 430/636 |
| 3,850,642 | 11/1974 | Bailey et al. | 430/539 |
| 4,192,683 | 3/1980 | Sakamoto et al. | 430/536 |
| 4,242,444 | 12/1980 | Habu et al. | 430/636 |
| 4,272,615 | 6/1981 | Yoneyama et al. | 430/631 |
| 4,292,402 | 9/1981 | Pollet et al. | 430/536 |

*Primary Examiner*—Richard L. Schilling
*Attorney, Agent, or Firm*—Sughrue, Mion, Zinn, Macpeak and Seas

[57] ABSTRACT

A photographic light-sensitive material with improved antistatic properties comprising a support having thereon at least one hydrophilic colloid layer containing (i) a nonionic surface active agent having a polyoxyethylene group, (ii) an anionic surface active agent represented by the following general formula (I)

$$R\text{-}(X)\text{-}SO_3M \qquad (I)$$

wherein R represents an alkyl group, an aryl group, an alkylaryl group or an alkenyl group; X represents $-O\text{-}(CH_2CH_2O)_m\text{-}C_{n1}H_{2n1}+1-$, $$-\underset{\underset{R_1}{|}}{CON}\text{-}(CH_2)_l-$$

or —O—; M represents a hydrogen atom, an alkali metal atom, an ammonium group or an animo group; m represents 0 or an integer of 1 to 25; $n_1$ represents an integer of 2 to 5; l represents an integer of 1 to 5; and $R_1$ represents a hydrogen atom or an alkyl group having 1 to 3 carbon atoms, and (iii) an anionic surface active agent represented by the following general formula (II)

$$[Rf-(A)_{l1}-(B)_{l2}-O]_{l3}-\overset{\overset{O}{\|}}{P}-(OM)_{3-n2} \qquad (II)$$

wherein Rf represents an alkyl group having 5 to 20 carbon atoms in which the hydrogen atom(s) are partly or completely replaced by fluorine atom(s); A represents $$-\underset{\underset{R_2}{|}}{SO_2N}-,\ -\underset{\underset{R_2}{|}}{CON}-$$

or —O—; $R_2$ has the same meaning as defined for $R_1$ in the general formula (I); l1 and l2 each represents 0 or 1; B represents an alkylene group, an arylene group, an aralkylene group or an ethyleneoxy group; M has the same meaning as defined in the general formula (I); $n_2$ represents 1 or 2; and l3 represents 1 or 2.

31 Claims, No Drawings

PHOTOGRAPHIC LIGHT-SENSITIVE MATERIAL WITH THREE SURFACE ACTIVE AGENTS

FIELD OF THE INVENTION

The present invention relates to a photographic light-sensitive material and, in particular, to a photographic light-sensitive material having excellent antistatic properties which is prepared by incorporating a nonionic surface active agent having a polyoxyethylene group and a specific anionic surface active agent into at least one layer of the photographic light-sensitive material.

BACKGROUND OF THE INVENTION

Antistatic property relates, in general, to surface resistivity and charge amount. Reduced surface resistivity and small charge amount are desired and it is also preferred that these properties do not deteriorate with the passage of time.

A photographic light-sensitive material generally comprises a support such as film of poly-α-olefin (e.g., polyethylene, polystyrene, etc.), a cellulose ester (e.g., cellulose triacetate, etc.), a polyester (e.g., polyethylene terephthalate, etc.), paper, synthetic paper or a paper sheet coated on both sides with such high molecular weight materials or the like, coated on one side or both sides with a light-sensitive photographic emulsion layer (or layers) with an interposed subbing layer provided to strongly adhere the support to the photographic emulsion layers and, if desired or necessary, various layers constituting photographic light-sensitive materials such as interlayers, protective layers, a backing layer, an antihalation layer or the like in various combinations.

Examples of a photographic light-sensitive material having coated on both sides of a support a photographic emulsion include, for example, an X-ray film for direct use. Most other photographic light-sensitive materials comprise a support coated only on the side with a photographic emulsion.

Therefore, the latter type of photographic materials have a photographic emulsion-free surface, i.e., the surface of the support is usually called the back side. Since photographic light-sensitive materials comprise a support and photographic layers having an electrical insulating property, electrostatic charges tend to be generated and accumulated during the production of photographic light-sensitive materials and during use thereof due to contact friction with or delamination from the surface of the same or different substances. This accumulated electrostatic charge can cause many difficulties. For example, in a photographic film before development processing, the light-sensitive emulsion layer is sensitive to the discharge of the accumulated electrostatic charge and dot-like spots or tree-like or feathery linear spots are formed after developing the photographic film. These spots are generally called static marks. Such marks seriously deteriorate or, in some cases, completely spoil the commercial value of photographic films. For example, it can easily be seen that static marks appearing in an X-ray film for medical or industrial use would lead to extremely dangerous mis-recognition. This phenomenon is confirmed only after development, and is therefore an extremely difficult problem. In addition, the accumulated electrostatic charge causes adhesion of dust on the film surface and secondary difficulties such as non-uniform coating or the like.

As is described above, such electrostatic charge often accumulates during production of photographic light-sensitive materials and upon use. For example, in production, electrostatic charges are generated through contact friction between the photographic film and rollers or separation between the support surface and the emulsion-coated surface in the steps of winding or unwinding photographic films. Also, with finished products, electrostatic charges are generated by delamination of a base surface from an emulsion-coated surface when winding of the photographic film occurs under a humidity high enough to cause film adhesion, or by the contact and delamination of X-ray film from mechanical parts in an automatic processing machine or from a fluorescent sensitizing paper. In addition, charges may also be generated by contact with a wrapping material. The problem with static marks on photographic light-sensitive materials formed by the accumulation of such electrostatic charge increases greatly by increasing the sensitivity of the photographic light-sensitive materials and increasing the processing velocity.

These frictional charges or delamination charges are considered to be caused by a mutual ionic action between the molecules of substances contacted. However, at present, it is difficult to predict from structural and chemical viewpoints what substance will be negatively charged and what substances positively charged.

One solution, however, is to reduce the charge voltage or to increase the electric conductance on the surface of a substance to thereby release electrostatic charge in an extremely short time before localized discharge, due to the accumulation of electric charge occurs to prevent such charging. Therefore, processes have been suggested for improving the electro-conductivity of the support or various coated surface layers of photographic light-sensitive materials, and various hygroscopic substances, water-soluble inorganic salts, certain surface active agents, polymers or the like have been utilized. For example, polymers as described in, e.g., U.S. Pat. Nos. 2,882,157, 2,972,535, 3,062,785, 3,262,807, 3,514,291, 3,615,531, etc., surface active agents as described in, e.g., British Pat. No. 861,134, U.S. Pat. Nos. 2,982,651, 3,428,456, 3,457,076, 3,454,625, 3,552,972, 3,655,387, etc., zinc oxide, semiconductors, colloid silica, etc., as described in, e.g., U.S. Pat. Nos. 3,062,700, 3,245,833, 3,525,621, etc. are known for this purpose.

Known processes for directly imparting an antistatic property to photographic film supports include processes for directly compounding such substances in a support of a high molecular weight material and processes for coating the same on the surface of the support. In the latter case, an antistatic agent is coated as a backing layer by using it alone or in combination with gelatin, polyvinyl alcohol, cellulose acetate or a like high molecular weight substance.

Also, a process for preventing charging of photographic light-sensitive materials, is known comprising incorporating an antistatic agent in a photographic emulsion layer or a surface protecting layer thereof, or coating a solution of an antistatic agent on the surface of these layers. However, many of these substances are quite specific in their action depending upon the kind of film support or the composition of the photographic materials. Thus, a particular agent providing good results for certain film supports, photographic emulsions or other photographic elements is useless for antistatic purpose with respect to other different film supports and photographic elements, and, in some cases, exerts a detrimental influence on photographic properties.

In general, with high speed emulsions few antistatic agents provide satisfactory antistatic effects under condition of low humidity (about 30% RH), or, in many cases, a reduction in antistatic effects and an increase of adhesion difficulties are involved at conditions of high temperature and high humidity. In particular, with light-sensitive materials wherein a photographic emulsion is coated on both sides of a support (like X-ray light-sensitive materials for direct use), it has been difficult to establish techniques using effectively antistatic agents.

Further, it has been particularly difficult to establish stable antistatic techniques since in many cases antistatic properties which have been achieved tend to decrease with the passage of time or by friction.

Also, in searching for antistatic agents for photographic light-sensitive materials, it is necessary to take into consideration sensitivity, fog, granularity, sharpness and like photographic properties, as well as to consider maintaining a suitable friction constant and of not deteriorating camera behavior or adhesion resistance. Since it is very difficult to apply antistatic agents to photographic light-sensitive materials and the selection of antistatic agent is restrictive in many cases as described above, various applications of antistatic agents to photographic materials have been contemplated.

SUMMARY OF THE INVENTION

Therefore, one object of the present invention is to provide a photographic light-sensitive material having an improved antistatic property without harming other photographic properties.

Another object of the present invention is to provide a photographic light-sensitive material having reduced surface resistivity and small charging amount and keeping these properties with the passage of time.

It has been found that these objects are attained with a photographic light-sensitive material comprising a support having thereon at least one hydrophilic colloid layer containing by:

(i) a nonionic surface active agent having a polyoxyethylene group, (ii) an anionic surface active agent represented by the following general formula (I)

$$R-(X)-SO_3M \qquad (I)$$

wherein R represents an alkyl group (preferably an alkyl group having 1 to 30 carbon atoms and particularly preferably 4 to 20 carbon atoms such as $C_{12}H_{25}$—, $C_{18}H_{37}$—, etc.); an aryl group (preferably an aryl group having 6 to 12 carbon atoms); an alkylaryl group (preferably an alkylaryl group having 7 to 30 carbon atoms such as

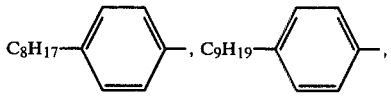

etc.) or an alkenyl group (preferably an alkenyl group having 3 to 30 carbon atoms such as $C_{17}H_{33}$—, $C_{18}H_{35}$—); X represents $-(O-CH_2CH_2O)_m-C_{n1}H_{2n1+1}$, $$-CON(R_1)(CH_2)_l-$$

or —O—; M represents a hydrogen atom, an alkali metal atom such as Na, K, etc., an ammonium group or an amino group (for example, a triethanolamino group or a diethyl-amino group, etc.); $R_1$ represents a hydrogen atom or an alkyl group having 1 to 3 carbon atoms such as $CH_3$—, etc.; m represents 0 or an integer of 1 to 25; $n_1$ represents an integer of 2 to 5; and l represents an integer of 1 to 5; and (iii) an anionic surface active agent represented by the following general formula (II)

$$[Rf-(A)_{l1}-(B)_{l2}-O]_{l3}-\overset{\overset{\displaystyle O}{\|}}{P}-(OM)_{3-n2} \qquad (II)$$

wherein Rf represents an alkyl group having 5 to 20 carbon atoms or an alkenyl group having 5 to 20 carbon atoms in which the hydrogen atom(s) are partly or completely replaced with fluorine atom(s), such as $C_5F_{11}$—, $C_6F_{13}$—, $C_8F_{17}$—, $C_{10}HF_{20}$—, $C_8HF_{16}$—, $C_6F_{11}$—, $C_9F_{17}$—, etc.; A represents $$-SO_2N(R_2)-,\ -CON(R_2)-$$

or —O—; $R_2$ represents an alkyl group having 1 to 5 carbon atoms; l1 and l2 each represents 0 or 1; B represents an alkylene group, an arylene group, an aralkylene group or an ethyleneoxy group; M has the same meaning as defined in the general formula (I); $n_2$ represents 1 or 2; and l3 represents 1 or 2.

A particularly preferred hydrophilic colloid layer is the outermost layer of the photographic light-sensitive material.

DETAILED DESCRIPTION OF THE INVENTION

The antistatic effect of surface active polyoxyethylene compounds is described in, for example, British Pat. No. 861,134 and Japanese Patent Application (OPI) No. 57427/75.

In the present invention, nonionic surface active polyoxyethylene compounds represented by the following general formulae (III) to (X) are particularly effective as nonionic surface active agent(s). As to the surface activity of the polyoxyethylene compound, the surface tension of an aqueous solution thereof is preferably about 45 dyne/cm or less at the critical concentration of micelle formation or greater.

$$R_3COO(CH_2CH_2O)_{n3}H \qquad (III)$$

wherein $R_3$ represents an alkyl group or an alkenyl group and preferably an alkyl group having 3 to 21 carbon atoms such as $C_{17}H_{35}$—, $C_{21}H_{43}$—, etc., or an alkenyl group having 3 to 21 carbon atoms such as $C_{16}H_{31}$—, $C_{18}H_{35}$—, etc.; and $n_3$ is 5 to 135.

$$R_4COO(CH_2CH_2O)_{n4}OCR_5 \qquad (IV)$$

wherein $R_4$ and $R_5$, which may be the same or different, each represents an alkyl group, the total number of the carbon atoms in $R_4$ and $R_5$ is preferably 6 to 34 such as $C_{11}H_{23}$—, $C_{18}H_{37}$—, etc.; and $n_4$ is 5 to 100, $$R_6O(CH_2CH_2O)_{n5}H \quad (V)$$

wherein $R_6$ represents an alkyl group or an alkenyl group which may be substituted with one or more fluorine atoms and preferably an alkyl group having 4 to 20 carbon atoms such as $C_{16}H_{33}$—, $C_{18}H_{37}$—, $C_{20}H_{41}$— or an alkenyl group having 4 to 22 carbon atoms such as $C_{18}H_{35}$—, $C_{20}H_{39}$—, $C_{16}H_{31}$—, etc.; and $n_5$ is 3 to 50,

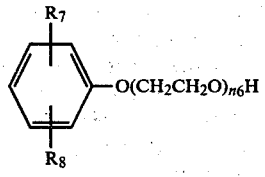
(VI)

wherein $R_7$ and $R_8$, which may be the same or different, each represents a hydrogen atom or an alkyl group which may be substituted with one or more fluorine atoms and preferably an alkyl group having 1 to 9 carbon atoms such as $C_3F_7$, $C_5F_{11}$, $C_9H_{19}$—, etc.; and $n_6$ is 3 to 150,

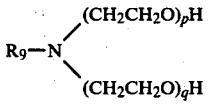
(VII)

wherein $R_9$ represents an alkyl group and preferably an alkyl group having 8 to 18 carbon atoms such as $C_{18}H_{37}$—, $C_{12}H_{25}$—; etc., and an alkenyl group preferably an alkenyl group having 8 to 18 carbon atoms, such as $C_{12}H_{23}$—, $C_{18}H_{35}$—, etc.; and p+q is 5 to 100, $$R_{10}S(CH_2CH_2O)_{n7}H \quad (VIII)$$

wherein $R_{10}$ represents an alkyl group and preferably an alkyl group having 4 to 18 carbon atoms such as $C_{12}H_{25}$—, $C_{16}H_{33}$—, etc.; and $n_7$ is 3 to 50, $$RfSO_2\underset{\underset{R_{11}}{|}}{N}(CH_2CH_2O)_{n8}H \quad (IX)$$

wherein Rf represents a perfluoroalkyl group preferably a perfluoroalkyl group having 3 to 12 carbon atoms and has the same embodiments for preferable groups as defined in the general formula (II); $R_{11}$ represents an alkyl group having about 5 carbon atoms or less such as $C_2H_5$—, $C_3H_7$—, etc.; and $n_8$ is 3 to 100,

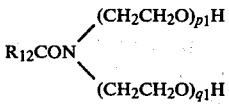
(X)

wherein $R_{12}$ represents an alkyl group or an alkenyl group and preferably an alkyl group having 4 to 17 carbon atoms such as $C_{12}H_{25}$—, $C_{16}H_{33}$—, etc., or an alkenyl group having 4 to 17 carbon atoms such as $C_{12}H_{23}$—, $C_{16}H_{31}$, etc.; and $p_1+q_1$ is 3 to 100, and a polymer having the following repeating unit,

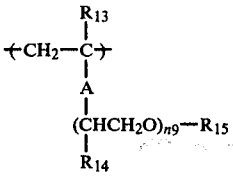
(XI)

wherein $R_{13}$ and $R_{14}$ represent a hydrogen atom or a methyl group; $R_{15}$ represents a hydrogen atom, an alkyl group having 1 to 5 carbon atoms or an aryl group having 7 to 12 carbon atoms; A represents —COO— or $$-\underset{\underset{R_{16}}{|}}{N}C-;$$

and $n_9$ is 1 to 50, ($R_{16}$ represents a hydrogen atom or an alkyl group having 1 to 3 carbon atoms). The nonionic surface active compound (XI) is described in Japanese Patent Application (OPI) Nos. 19043/81 and 19047/81.

Of these polyoxyethylene type surface active agents, particularly preferred compounds are set forth below, but the present invention is not to be construed as being limited thereto.

$$C_{12}H_{25}O(CH_2CH_2O)_{10}H \quad (A)$$

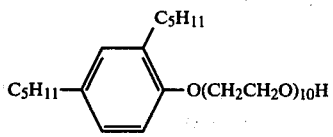
(B)

$$C_{17}H_{35}COO(CH_2CH_2O)_{20}H \quad (C)$$

$$C_{11}H_{23}COO(CH_2CH_2O)_{25}OCC_{11}H_{23} \quad (D)$$

$$C_{16}H_{33}O(CH_2CH_2O)_{15}H \quad (E)$$

(F)

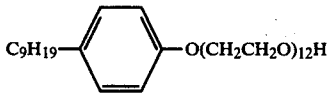

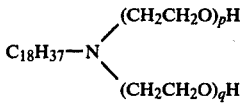
(G)

p + q = 30

$$C_8F_{17}SO_2-\underset{\underset{C_3H_7}{|}}{N}(CH_2CH_2O)_{20}H \quad (H)$$

$$\text{(I)}\quad \underset{\underset{COO(CH_2CH_2O)_{10}H}{|}}{(CH-CH)}$$

$$\text{(J)}\quad \underset{\underset{CONH(CH_2CH_2O)_{20}H}{|}}{(CH-CH)}$$

Of the anionic surface active agents (ii) represented by the general formula (I), specific examples of preferred compounds are set forth below, but the present invention is not to be construed as being limited thereto.

$$C_{17}H_{33}CON(CH_3)CH_2CH_2SO_3Na \quad \text{(I - a)}$$

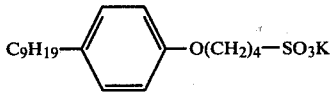

(I - b)

$$C_{12}H_{25}OSO_3Na \quad \text{(I - c)}$$

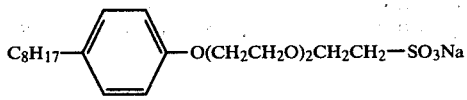

(I - d)

$$C_{13}H_{35}OSO_3Na \quad \text{(I - e)}$$

Specific examples of anionic surface active agents (iii) represented by the general formula (II) are set forth below, but the present invention is not to be construed as being limited thereto.

$$C_8F_{17}SO_2N(C_2H_5)CH_2CH_2OP(=O)(OH)_2 \quad \text{(II - a)}$$

$$C_8F_{17}SO_2N(C_3H_7)CH_2CH_2OP(=O)(ONa)_2 \quad \text{(II - b)}$$

$$(C_8F_{17}SO_2N(C_2H_5)CH_2CH_2O)_2-P(=O)-OH \quad \text{(II - c)}$$

$$(C_8F_{17}CH_2O)_2-P(=O)-ONa \quad \text{(II - d)}$$

$$C_8F_{17}SO_2N(C_3H_7)CH_2CH_2OP(=O)(ONH_4)_2 \quad \text{(II - e)}$$

$$C_8F_{17}SO_2N(C_3H_7)CH_2CH_2OP(=O)(OH)(ONa) \quad \text{(II - f)}$$

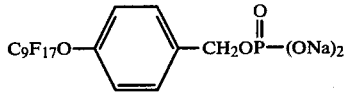

(II - g)

$$H(CF_2)_{10}CH_2OP(=O)(ONa)_2 \quad \text{(II - h)}$$

$$C_8F_{17}SO_2N(C_2H_5)(CH_2CH_2O)_5-P(=O)(ONa)_2 \quad \text{(II - i)}$$

$$C_6F_{11}O(CH_2CH_2O)_3-P(=O)(OH)-ONa \quad \text{(II - j)}$$

-continued $$H(CF_2)_8-CONHCH_2CH_2CH_2OP(=O)-(OK)_2 \quad \text{(II - k)}$$

In applying the compounds used in the present invention having an antistatic effect to a photographic light-sensitive material, they are dissolved in water or an organic solvent (e.g., methanol, isopropanol, acetone, etc.) or a mixture of both water and the above described organic solvent, added to a coating solution for a layer of a photographic light-sensitive material, for example, of an outermost layer (e.g., a protective layer, a backing layer or both), and coated by dip coating, air knife coating, extrusion coating using a hopper as described in U.S. Pat. No. 2,681,294, or simultaneously with another photographic material constituting layer(s) as described in U.S. Pat. Nos. 3,508,947, 2,941,898, 3,526,528, etc., or else, a photographic layer is immersed in the solution of the compounds.

The nonionic surface active polyoxyethylene compound (i), and the anionic surface active agents (ii) and (iii) are used in amounts sufficient to provide an antistatic effect. A preferred amount of the polyoxyethylene compound (i) ranges from about 5 to about 500 mg/m$^2$, in particular 60 to 100 mg/m$^2$, a preferred amount of the anionic surface active agent (ii) represented by the general formula (I) ranges from about 0.01 to about 100 mg/m$^2$, in particular 0.1 to 30 mg/m$^2$, and a preferred amount of the anionic surface active agent (iii) represented by the general formula (II) ranges from about 0.01 to about 50 mg/m$^2$, in particular 0.1 to 10 mg/m$^2$.

The above-described ranges, of course, will vary depending upon the kind of photographic film support used, the photographic composition and the form or coating process used.

Suitable supports for the photographic light-sensitive material of the present invention include a cellulose nitrate film, a cellulose acetate film, a cellulose acetate butyrate film, a cellulose acetate propionate film, a polystyrene film, a polyethylene terephthalate film, a polycarbonate film, a laminate thereof, a paper, etc. Further, a baryta coated paper and a paper coated or laminated with an $\alpha$-olefin polymer, in particular, polyethylene, polypropylene, and the like can be used.

In the photographic light-sensitive material of the present invention, it is advantageous to use gelatin as a binder of each photographic material constituting layer. However, other hydrophilic colloids can also be used. Hydrophilic colloids which can be used include proteins, such as gelatin derivatives, graft polymers of gelatin and other polymers, albumin, and casein; cellulose derivatives, such as hydroxyethyl cellulose, carboxymethyl cellulose, and cellulose sulfuric acid ester; saccharide derivatives, such as sodium alginate, and starch derivatives; and a wide variety of synthetic hydrophilic high molecular weight substances, for example, homopolymers or copolymers such as polyvinyl alcohol, a partial acetal of polyvinyl alcohol, poly-N-vinyl pyrrolidone, polyacrylic acid, polymethacrylic acid, polyacrylamide, polyvinyl imidazole, and polyvinyl pyrazole.

Gelatin as used herein may be either lime-processed gelatin, acid-processed gelatin or enzyme-processed gelatin as described in *Bull. Soc. Sci. Phot. Japan*, No. 16, page 30 (1966). In addition, a hydrolyzed product of gelatin and an enzyme-decomposition product of gelatin may also be used. As the gelatin derivatives, those obtained by reacting gelatin with a various compounds, for example, an acid halide, an acid anhydride, an isocyanate, a bromoacetic acid, an alkanesultone, a vinylsulfonamide, a maleinimide compound, a polyalkylene oxide, an epoxy compound, etc.

The silver halide emulsion of the photographic light-sensitive material used in the present invention is usually prepared by mixing a water-soluble silver salt (e.g., silver nitrate, etc.) solution with a water-soluble halide (e.g., potassium bromide, etc.) solution in the presence of a solution of a water-soluble high molecular weight polymer such as gelatin. Examples of silver halides, which can be used include mixed silver halides such as silver chlorobromide, silver bromoiodide, silver chloroiodobromide, etc. as well as silver chloride and silver bromide. Grains of these silver halide can be formed using known processes. They can be prepared using a single jet process, a double jet process, or a controlled double jet process, etc. These photographic emulsions are described in T. H. James and C. E. K. Mees; *The Theory of the Photographic Process,* 3rd ed. (published by MacMillan Co.), P. Glafikides; *Chemie Photographique* (published by Paul Montel) or like texts; and can be prepared according to various processes commonly used in the art, such as an ammoniacal process, a neutral process, an acidic process, etc.

The silver halide emulsion is usually subjected to a chemical sensitization although the so-called primitive emulsion, which is not subjected to chemical sensitization, can be used. Those chemical sensitization methods are described in Glafikides supra, and H. Frieser, *Die Grundlagen der Photographischen Prozesse mit Silberhalogeniden* (Akademische Verlagsgesellschaft, 1968) can be used. That is, a sulfur sensitization method in which a compound containing a sulfur atom capable of reacting with a silver ion or active gelatin is used, a reduction sensitization method in which a reducing agent is used, a noble metal sensitization method in which a gold compound or other noble metal compound is used, and the like can be used alone or as a combination thereof. Examples of sulfur sensitizing agents which can be used include a thiosulfate, a thiourea, a thiazole, a rhodanine, and the like. Specific examples of these compounds are described in, for example, U.S. Pat. Nos. 1,574,944, 2,410,689, 2,278,947, 2,728,668, 3,656,955, 4,032,928 and 4,067,740. Examples of reduction sensitizing agents which can be used include a stannous salt, an amine, a hydrazine derivative, formamidinesulfinic acid, a silane compound, and the like. Specific examples of these compounds are described in, for example, U.S. Pat. Nos. 2,487,850, 2,419,974, 2,518,698, 2,983,609, 2,983,610, 2,694,637, 3,930,867 and 4,054,458. For the noble metal sensitization, a gold complex salt and a complex salt of a metal belonging to Group VIII of the Periodic Table, such as platinum, iridium, palladium, etc. can be used. Specific examples of these compounds are described in, for example, U.S. Pat. Nos. 2,399,083 and 2,448,060, and British Pat. No. 618,061.

The photographic emulsion may be subjected, if desired, to spectral sensitization or supersensitization using cyanine, merocyanine, carbocyanine or like polymethine sensitizing dyes, alone or in combination, or in further combination with styryl dyes.

Various compounds can be added to the photographic emulsion of the photographic light-sensitive material used in the invention in order to prevent a reduction in sensitivity and the formation of fog during production, storage or processing of the light-sensitive material. A wide variety of compounds which are known as antifoggants or stabilizers can be used, viz., an azole, such as benzothiazolium salt, a nitroindazole, a nitrobenzimidazole, a chlorobenzimidazole, a bromobenzimidazole, a mercaptothiazole, a mercaptobenzothiazole, a mercaptobenzimidazole, a mercaptothiadiazole, an aminotriazole, a benzotriazole, a nitrobenzotriazole, and a mercaptotetrazole (particularly, 1-phenyl-5-mercaptotetrazole); a mercaptopyrimidine; a mercaptotriazine, a thioketo compound, such as an oxazolithione; an azaindene, such as a triazaindene, a tetraazaindene (particularly, a 4-hydroxy-substituted(1,3,3a,7)tetrazaindene), and a pentaazaindene; benzenethiosulfonic acid, benzenesulfinic acid, benzenesulfonic acid amide, etc. For example, the compounds described in U.S. Pat. Nos. 3,954,474 and 3,982,947, Japanese Patent Publication No. 28660/77, etc., can be used.

The photographic emulsion layer of the photographic light-sensitive material of the present invention may contain a color forming coupler, that is, a compound capable of forming a dye upon oxidative coupling with an aromatic primary amine developing agent (for example, a phenylenediamine derivative, an aminophenol derivative, etc.) in color development processing. For instance, examples of magenta couplers are 5-pyrazolone couplers, pyrazolobenzimidazole couplers, cyanoacetylcoumarone couplers, open chain acylacetonitrile couplers, etc.; examples of yellow couplers are acylacetoamide couplers (for example, benzoylacetanilides, pivaloylacetanilides, etc.), etc.; and examples of cyan couplers are naphthol couplers, phenol couplers, etc.

Non-diffusible couplers which contain a hydrophobic group, called a ballast group, in the molecule thereof are preferred as couplers. Couplers can be 4-equivalent or 2-equivalent couplers based on a silver ion. In addition, colored couplers providing a color correction effect, or couplers which release development inhibitors upon development (the so-called DIR couplers) can also be used. Furthermore, non-color-forming DIR coupling compounds which provide a colorless product and release a development inhibitor in the coupling reaction can be employed.

The photographic light-sensitive material of the present invention can contain in the photographic emulsion layer and other hydrophilic colloid layers, an inorganic or organic hardening agent. For example, a chromium salt (for example, chromium alum and chromium acetate, etc.), an aldehyde (for example, formaldehyde, glyoxal, glutaraldehyde, etc.), an N-methylol compound (for example, dimethylol urea, methylol dimethylhydantoin, etc.), a dioxane derivative (for example, 2,3-dihydroxydioxane, etc.), an active vinyl compound (for example, 1,3,5-triacryloylhexahydro-s-triazine, 1,3-vinylsulfonyl-2-propanol, etc.), an active halogen compound (for example, 2,4-dichloro-6-hydroxy-s-triazine, etc.), a mucohalic acid (for example, mucochloric acid, mucophenoxychloric acid, etc.), and the like can be used alone or in combination.

The above-described hardening agents and other hardening agents which can be used in the present invention are described in, for example, U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827 and 3,543,292, British Pat. Nos. 676,628, 825,544 and 1,270,578, German Pat. Nos.

872,153 and 1,090,427, Japanese Patent Publication Nos. 7133/59 and 1872/71 and *Research Disclosure*, Vol. 176, page 26 (December 1978), etc.

Surface active agents alone or in combination may be added to the photographic material constituting layers of the present invention. They are used as a coating aid but, in some cases, they are used for other purposes, e.g., for the improvement of emulsion dispersion, sensitization and other photographic properties, to provide a desired adjustment in the triboelectric charging propensity of the surface, etc.

These surface active agents are classified into natural surface active agents such as saponin; nonionic surface active agents such as of the alkyleneoxide series, glycerin series, glycidol series, etc.; cationic surface active agents such as higher alkylamines, quaternary ammonium salts, heterocyclic compounds (e.g., pyridine, etc.), phosphonium compounds, sulfonium compounds, etc.; anionic surface active agents having an acidic group such as a carboxylic acid group, a sulfonic acid group, a phosphoric acid group, a sulfuric ester group, a phosphoric acid ester group, etc.; amphoteric surface active agents such as aminoacids, aminosulfonic acids, aminoalcohol sulfuric or phosphoric esters, etc.

Examples of usable surface active agents are described in part in patents such as U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, 3,545,947, 3,666,478, 3,507,660, British Pat. No. 1,198,450, etc.

In the present invention, specific combinations of these surface active agents are used in layers constituting the silver halide photographic light-sensitive material, such as a light-sensitive emulsion layer, a filter layer, an interlayer, a surface protecting layer, a backing layer, an anti-halation layer, an overcoat layer, etc. Of these, surface active agents other than those of the present invention can be used together with the nonionic polyoxyethylene compound and the anionic surface active agents represented by the general formulae (I) and (II) according to the present invention in a layer preferably in an outermost layer such as a surface protective layer, a backing layer, etc.

The photographic light-sensitive material of the present invention can contain in the photographic layers thereof a polymer latex described in U.S. Pat. Nos. 3,411,911 and 3,411,912, Japanese Patent Publication No. 5331/70, etc., and, as a plasticizer, polyols as described in, for example, U.S. Pat. Nos. 2,960,404, 3,042,524, 3,520,694, 3,656,956, 3,640,721, etc.

Also, silver halide, silica, strontium sulfate, barium sulfate, polymethyl methacrylate, etc., may be used as a matting agent.

The present invention has overcome the problems caused by electrostatic charges generated during production of photographic light-sensitive materials and/or upon use thereof.

For example, the present invention remarkably causes a reduction in the generation of static marks formed by contact between an emulsion-coated surface and a backing layer of a photographic light-sensitive material, by contact between emulsion-coated surfaces and by contact with substances with which photographic light-sensitive materials often come into contact, such as rubber, metal, plastics, fluorescent-sensitizing paper, etc.

It is particularly surprizing that when the compounds of the present invention are applied to at least one layer of a photographic light-sensitive material as shown in the following Examples, the surface resistivity is remarkably reduced, and the charging amount is remarkably reduced. Further, when the nonionic surface active agent having a polyoxyethylene group and the compound represented by the general formulae (I) and (II) are used together, the reduction surface resistivity and charge amount are particularly remarkable.

The technique for improving the anti-static property by the use of the nonionic surface active agent having a polyoxyethylene group together with the anionic surface active agent represented by the general formula (I) has been known. However, in this case surface resistivity is reduced by charging amount is not reduced. In order to reduce the charging amount, another surface active agent is further used together. In general, this results in an increase in the surface resistivity. On the contrary, when the compound represented by the general formula (II) is used additionally such a disadvantage does not occur. The most usually used surface active agents and known anti-static agents for photographic use, such as saponin, saccharose aliphatic acid esters and compounds as described in U.S. Pat. Nos. 2,982,651, 3,253,922 and 3,220,847, scarcely reduce surface resistivity when applied to an outermost layer.

Also, the compounds used in the present invention extremely effectively prevent electrostatic charging, even at low humidity, e.g., which is generated when photographic film is loaded into a cassette or into a camera and when photographing continuously at high speed using large amounts of film using an automatic photographing machine as with X-ray films. In addition, the antistatic effect does not deteriorate with the passage of time or due to friction.

The present invention is now illustrated in more detail by the following examples of the present invention which, however, are not to be construed as limiting the present invention. Unless otherwise indicated herein, all parts, percents, ratios and the like are by weight.

EXAMPLE 1

Samples (1) to (8) comprising a protective layer, a silver halide emulsion layer, a polyethylene terephthalate film support, an emulsion layer and a protective layer in this order were prepared by coating and drying in a conventional manner. The composition of each layer is shown below.

Emulsion Layer

Binder: 3 g/m$^2$ of gelatin
Coated Silver Aamount: 4 g/m$^2$
Silver Halide Composition: AgI (1.5 mole %)+AgBr (98.5 mole %)
Hardening Agent: 2,4-dichloro-6-hydroxy-1,3,5-triazine sodium salt (0.4 g/100 g gelatin)
Antifogging Agent: 1-phenyl-5-mercaptotetrazole (0.5 g/100 g Ag)

Protective Layer

Binder: 1.7 g/m$^2$ of gelatin
Hardening Agent: 2-hydroxy-4,6-dichloro-s-triazine sodium salt (0.4 g/100 g binder)

The protective layer further contained a nonionic compound and an anionic compound or saponin, as a control sample, as shown in Table 1 below.

TABLE 1

| Sample No. | Contents of Samples: Nonionic Surface Active Agent | Compound of General Formula I | Compound of General Formula II |
|---|---|---|---|
| 1 (Comparison) | A(50) | — | — |
| 2 (Comparison) | A(50) | I-b(10) | — |
| 3 (Invention) | A(50) | I-b(10) | II-a(1) |
| 4 (Invention) | A(50) | I-b(10) | II-e(1) |
| 5 (Invention) | A(50) | I-b(10) | II-f(1) |
| 6 (Invention) | A(50) | I-b(10) | II-f(1) |
| 7 (Control) | — | — | — |
| 8 (Comparison) | Saponin(100) | — | — |

Numerical values in parentheses show the amount of antistatic agent added in $mg/m^2$.

After conditioning the samples at 25° C. and 30% RH for 10 hours, the surface resistivity, the charging amount and the amount of static marks generated of these samples of photographic film were measured in the following manner.

(i) Measurement of Surface Resistivity

A sample piece was placed between brass electrodes having a 0.14 cm electrode gap and a 10 cm length (portions thereof in contact with the sample piece being made of stainless steel), and 1 minute value was read using an electrometer (TR-8651) made by Takeda Riken Co. (this test was conducted under conditions of 25° C.; 30% RH), whereafter the surface resistivity was calculated according to Ohm's law. The smaller the value of surface resistivity, the better the antistatic property.

(ii) Measurement of Charging Amount

A sample piece of a size of 3 cm×17 cm was rolled with a rubber roller having a load of 380 g at a speed of 25 cm/sec. and the charging amount of the sample was measured using a Faraday gauge.

(iii) Measurement of Generation of Static Marks

The surface of a photographic film sample and a white rubber plate were superposed one over the other and pressure applied to the assembly by applying a rubber roller to the white rubber plate under the conditions of 25° C. and 40% RH. The white rubber plate was then removed, and the sample developed, fixed and washed to examine the amount of static marks generated.

The results for the samples shown in Table 1 above are shown in Table 2 below.

TABLE 2

| Sample No. | Results of Measurement: Surface Resistivity (Ω) | Charging Amount (coulomb) | Amount of Static Marks Generated |
|---|---|---|---|
| 1 | $1.8 \times 10^{13}$ ($7.0 \times 10^{13}$) | $+6.3 \times 10^{-7}$ ($+2.5 \times 10^{-6}$) | C (D) |
| 2 | $9.5 \times 10^{10}$ ($9.7 \times 10^{10}$) | $+3.6 \times 10^{-7}$ ($+2.0 \times 10^{-6}$) | B (C) |
| 3 | $9.0 \times 10^{10}$ ($9.5 \times 10^{10}$) | $-4.0 \times 10^{-8}$ ($-3.5 \times 10^{-8}$) | A (A) |
| 4 | $9.0 \times 10^{10}$ ($9.5 \times 10^{10}$) | $-3.0 \times 10^{-8}$ ($-2.0 \times 10^{-8}$) | A (A) |
| 5 | $7.0 \times 10^{10}$ ($9.5 \times 10^{10}$) | $-4.5 \times 10^{-8}$ ($-3.5 \times 10^{-8}$) | A (A) |
| 6 | $6.5 \times 10^{10}$ ($8.0 \times 10^{10}$) | $-4.0 \times 10^{-8}$ ($-3.5 \times 10^{-8}$) | A (A) |
| 7 | $2.0 \times 10^{14}$ ($2.0 \times 10^{14}$) | $+8.5 \times 10^{-5}$ ($+8.5 \times 10^{-5}$) | E (E) |
| 8 | $2.0 \times 10^{14}$ ($2.0 \times 10^{14}$) | $-4.0 \times 10^{-8}$ ($-4.0 \times 10^{-8}$) | D (D) |

Numerical values in parentheses show the results for samples after storage for 3 months.

The amount of static marks was evaluated using the following 5 stages.

| Grade | Static Mark Generation |
|---|---|
| A | None |
| B | Slight |
| C | Considerable |
| D | Remarkable |
| E | Over entire surface |

It is apparent from the results in Table 2 that the antistatic properties are remarkably improved by incorporating into a protective layer both of a polyoxyethylene compound and an anionic surface active agent represented by the general formula (I) and an anionic surface active agent represented by the general formula (II) according to the present invention and particularly a good stability is obtained in comparison with use of a polyoxyethylene compound alone.

EXAMPLE 2

Samples (11), (12), (13), (14), (15) and (16) comprising a cellulose triacetate support, an antihalation layer, a red-sensitive layer, an interlayer, a green-sensitive layer, a yellow filter layer, a blue-sensitive layer and a protective layer in this order were prepared by coating and drying in a conventional manner. The composition of each layer is shown below.

Antihalation Layer

Binder: 4.4 $g/m^2$ of gelatin

Hardener: bis(vinylsulfonylmethyl)ether (5 g/100 g binder)

Coating Aid: 4 $mg/m^2$ of sodium dodecylbenzenesulfonate

Antihalation Agent Component: 0.4 $g/m^2$ of black colloidal silver

Red-Sensitive Layer

Binder: 7 $g/m^2$ of gelatin

Hardener: 2-hydroxy-4,6-dichloro-s-triazine sodium salt (0.7 g/100 g binder)+bis(vinylsulfonylmethyl)ether (2 g/100 g binder)

Coating Aid: 10 $mg/m^2$ of sodium dodecylbenzenesulfonate

Coated Silver Amount: 3.1 $g/m^2$

Silver Halide Composition: 2 mole % of AgI+98 mole % of AgBr

Antifogging Agent: 4-hydroxy-6-methyl-1,3,3a,7-tetrazaindene (0.9 g/100 g Ag)

Color Coupler: 1-hydroxy-4-(2-acetylphenyl)azo-N-[4-(2,4-di-tert-amylphenoxy)butyl]-2-naphthamide (38 g/100 g Ag)

Sensitizing Dye: anhydro-5,5'-dichloro-9-ethyl-3,3'-di(3-sulfopropyl)thiacarbocyanine hydroxide pyridinium salt (0.3 g/100 g Ag)

Interlayer

Binder: 2.6 g/m$^2$ of gelatin
Hardener: bis(vinylsulfonylmethyl)ether (6 g/100 g binder)
Coating Aid: 12 mg/m$^2$ of sodium dodecylbenzenesulfonate Green-Sensitive Layer Binder: 6.4 g/m$^2$ of gelatin
Hardener: 2-hydroxy-4,6-dichloro-s-triazine sodium salt (0.7 g/100 g binder)+bis(vinylsulfonylmethyl)ether (2 g/100 g binder)
Coating Aid: 9 mg/m$^2$ of sodium dodecylbenzenesulfonate
Coated Silver Amount: 2.2 g/m$^2$
Silver Halide Composition: 3.3 mole % of AgI+96.7 mole % of AgBr
Stabilizer: 4-hydroxy-6-methyl-1,3,3a,7-tetrazaindene (0.6 g/100 g Ag)
Color Coupler: 1-(2,4,6-trichlorophenyl)-3-{3-(2,4-di-tert-amylphenoxy)acetamido}-4-(4-methoxyphenyl-)azo-5-pyrazolone (37 g/100 g Ag)
Sensitizing Dye: anhydro-5,5'-diphenyl-9-ethyl-3,3'-di(2-sulfoethyl)oxacarbocyanine hydroxide pyridinium salt (0.3 g/100 g Ag)

Yellow Filter Layer

Binder: 2.3 g/m$^2$ of gelatin
Filter Component: 0.7 g/m$^2$ of yellow colloidal silver
Hardener: bis(vinylsulfonylmethyl)ether (5 g/100 g binder)
Surface Active Agent: 7 mg/m$^2$ of bis(2-ethylhexyl)-2-sulfonatosuccinate sodium salt Blue-Sensitive Layer Binder: 7 g/m$^2$ gelatin
Hardener: 2-hydroxy-4,6-dichloro-s-triazine sodium salt (0.7 g/100 g binder)+bis(vinylsulfonylmethyl)ether 2 g/100 g binder)
Coating Aid: 8 mg/m$^2$ of sodium dodecylbenzenesulfonate
Coated Silver Amount: 2.2 g/m$^2$
Silver Halide Composition: 3.3 mole % of AgI+96.7 mole % of AgBr
Stabilizing Agent: 4-hydroxy-6-methyl-1,3,3a,7-tetrazaindene (0.4 g/100 g Ag)
Color Coupler: 2'-chloro-5'-[2-(2,4-di-tert-amylphenoxy)butyramido]-α-(5,5'-dimethyl-2,4-dioxo-3-oxazolidinyl)-α-(4-methoxybenzoyl)acetnilide (45 g/100 g Ag)

Protective Layer

Binder: 2 g/m$^2$ of gelatin+0.3 g/m$^2$ of styrenemaleic anhydride (1:1 molar) copolymer (mean molecular weight: about 100,000)
Hardener: bis(vinylsulfonylmethyl)ether (5 g/100 g binder)
Coating Aid: 5 mg/m$^2$ of sodium dioctylsulfosuccinate The protective layer further contained a nonionic compound and the compounds according to the present invention as shown in Table 3 below.

TABLE 3

| Contents of Samples | | | |
|---|---|---|---|
| Sample No. | Nonionic Surface Active Agent | Compound of General Formula I | Compound of General Formula II |
| 11 | A(50) | — | — |
| 12 | A(50) | I-b(10) | — |
| 13 | A(50) | I-b(10) | II-a(1) |
| 14 | A(50) | I-b(10) | II-e(1) |
| 15 | A(50) | I-b(10) | II-f(1) |
| 16 (Blank) | — | — | — |

Numerical values in parentheses show the amount of antistatic agent added in mg/m$^2$.

After conditioning the samples at 25° C. and 30% RH for 10 hours, the surface resistivity and the amount of static marks generated in these photographic films were determined. The results of measurement are shown in Table 4 below.

TABLE 4

| Results of Measurement | | |
|---|---|---|
| Sample No. | Surface Resistivity (Ω) | Amount of Static Marks Generated |
| 11 | $8.0 \times 10^{12}$ | C |
| 12 | $7.0 \times 10^{10}$ | A |
| 13 | $5.5 \times 10^{10}$ | A |
| 14 | $5.5 \times 10^{10}$ | A |
| 15 | $5.0 \times 10^{10}$ | A |
| 16 | $1.8 \times 10^{13}$ | D |

It is apparent from the results in Table 4 above that antistatic properties are remarkably improved by incorporating into a protective layer both a polyoxyethylene compound and an anionic surface active agent represented by the general formula (I) and an anionic surface active agent represented by the general formula (II).

EXAMPLE 3

A photographic emulsion coating solution prepared by adding additives such as a stabilizer and a hardening agent to a high speed silver halide emulsion for X-rays containing 6% of gelatin and 6% of silver iodobromide (silver iodide: 1.5 mole %) was applied to a polyethylene terephthalate film having a subbing layer thereon, and then an aqueous solution containing gelatin as a major component which did not contain an antistatic agent was applied on the silver halide emulsion layer to form a surface protective layer. The compositions of each layer are shown in Table 5 below.

TABLE 5

| Coating Solution Composition (per Kg) | | |
|---|---|---|
| Component | Coating Solution for Emulsion Layer | Coating Solution for Protective Layer |
| Binder | Gelatin 60g | Gelatin 50g |
| Silver | Silver iodobromide 60g | — |
| Hardening Agent | Sodium salt of 2-hydroxy-4,6-dichloro-s-triazine | 2% Aqueous solution of sodium salt of 2-hydroxy-4,6-dichloro-s-triazine (10 ml) |
| Stabilizer | 1-Phenyl-5-mercapto-tetrazole | — |
| Water | 880 ml | 950 ml |

(Film thickness: Emulsion layer: 5μ, Protective layer: 1μ)

Each resulting sample was divided into test samples and each sample was dipped in a 3% aqueous solution of the compound shown in Table 6 below (in the case of a mixture, 70 wt% of A, 25 wt% of a compound of general formula (I) and 5 wt% of a compound of general formula (II) were used within the total amount of 3%) for 30 seconds respectively and then dried. For comparison, samples were processed in the same manner with a 3% aqueous solution of saponin, succharose monolaurate or polyoxyethylene nonylphenyl ether, respectively. After conditioning these samples at 25° C. and 30% RH for 10 hours, the surface resistivity of these samples of photographic film was determined in the following manner.

Further, generation of the static marks was evaluated by superposing a white rubber plate on a surface of the sample, pressing the white rubber plate with a rubber roll at 25° C. and 40% RH to produce friction, removing the white rubber plate, developing the sample in a developer solution having the following composition and fixing the sample.

| Composition of Developer Solution: | |
|---|---|
| Warm Water (50° C.) | 700 ml |
| N—Methyl-p-aminophenol Sulfate | 4 g |
| Sodium Sulfite (anhydrous) | 60 g |
| Hydroquinone | 10 g |
| Sodium Carbonate (monohydrate) | 53 g |
| Potassium Bromide | 25 g |
| Water to make | 1 liter |

The measurement of surface resistivity was carried out in the manner by placing a sample piece between brass electrodes having a electrode gas of 0.14 cm and a length of 10 cm (portions thereof in contact with the sample piece were made of stainless steel), and 1 minute value was read using an insulation meter (MM-V-M type) made by Takeda Riken Co. The results obtained are shown in Table 6 below.

TABLE 6

| Antistatic Test Results | | | |
|---|---|---|---|
| Sample No. | Antistatic Agent | Surface Resistivity (Ω) | Amount of Static Marks Generated |
| 21 | A | $5.5 \times 10^{12}$ | O |
| 22 | A + I-b | $4.0 \times 10^{10}$ | B |
| 23 | A + I-b + II-a | $4.5 \times 10^{10}$ | A |
| 24 | A + I-b + II-e | $4.6 \times 10^{10}$ | A |
| 25 | A + I-b + II-f | $4.5 \times 10^{10}$ | A |
| 26 | Succharose Monolaurate | $5.5 \times 10^{13}$ | D |
| 27 | Polyoxyethylene Nonylphenyl Ether (n = 10) | $3.2 \times 10^{13}$ | D |
| 28 | None (Control) | $1.2 \times 10^{14}$ | E |

The evaluation of antistatic property was the same as described above.

As is clear from the results in Table 6, in the photographic films processed with the aqueous solution containing the compounds according to the present invention (Sample Nos. 23, 24 and 25), the generation of static marks was almost not observed or completely not observed and the surface resistivity decreased remarkably. On the other hand, in the samples processed with polyoxyethylene compound A, saponin, succharose monolaurate and polyoxyethylene nonylphenyl ether (Sample Nos. 21, 26 and 27), static marks markedly occurred and the surface resistivity hardly decreased. In the control sample (Sample No. 28), the entire surface was covered with mottle like static marks.

While the invention has been described in detail and with reference to specific embodiments thereof, it will be apparent to one skilled in the art that various changes and modifications can be made therein without departing from the spirit and scope thereof.

What is claimed is:

1. A light-sensitive material comprising a support and one or more hydrophilic colloid layers including at least one light-sensitive silver halide emulsion layer, at least one hydrophilic colloid layer containing (i) a nonionic surface active agent having a polyoxyethylene group, (ii) an anionic surface active agent represented by the following general formula (I)

$$R\text{-}(X)\text{-}SO_3M \qquad (I)$$

wherein R represents an alkyl group, an aryl group, an alkylaryl group or an alkenyl group; X represents $-O-(CH_2CH_2O)_m-C_{n_1}H_{2n_1+1}-$, $$-\underset{\underset{R_1}{|}}{CON}-(CH_2)_l-$$

or —O—; M represents a hydrogen atom, an alkali metal atom, an ammonium group or an amino group, m represents 0 or an integer of 1 to 25; $n_1$ represents an integer of 2 to 5; l represents an integer of 1 to 5; and $R_1$ represents a hydrogen atom or an alkyl group having 1 to 3 carbon atoms, and (iii) an anionic surface active agent represented by the following general formula (II)

$$[Rf-(A)_{l1}-(B)_{l2}-O]_{l3}-\overset{\overset{O}{\|}}{P}-(OM)_{3-n2} \qquad (II)$$

wherein Rf represents an alkyl group having 5 to 20 carbon atoms or an alkenyl group having 5 to 20 carbon atoms in which the hydrogen atom(s) are partly or completely substituted with fluorine atom(s); A represents $$-\underset{\underset{R_2}{|}}{SO_2N}-,\ -\underset{\underset{R_2}{|}}{CON}-$$

or —O—; $R_2$ has the same meaning as defined for $R_1$ in the general formula (I); l1 and l2 each represents 0 or 1; B represents an alkylene group, an arylene group, an aryalkylene group or an ethyleneoxy group; M has the same meaning as defined in the general formula (I); $n_2$ represents 1 or 2; and l represents 1 or 2.

2. The photographic light-sensitive material as claimed in claim 1, wherein R represents an alkyl group having 1 to 30 carbon atoms.

3. The photographic light-sensitive material as claimed in claim 1, wherein R represents an aryl group having 6 to 12 carbon atoms.

4. The photographic light-sensitive material as claimed in claim 1, wherein R represents an alkylaryl group having 7 to 30 carbon atoms.

5. The photographic light-sensitive material as claimed in claim 1, wherein R represents an alkenyl group having 3 to 30 carbon atoms.

6. The photographic light-sensitive material as claimed in claim 1, wherein said nonionic surface active agent (i) is a nonionic surface active agent providing a surface tension in an aqueous solution of about 45 dyne/cm or less at the critical micelle concentration or greater.

7. The photographic light-sensitive material as claimed in claim 1, wherein said nonionic surface active agent (i) is a nonionic surface active polyoxyethylene compound represented by the following general formula (III):

$$R_3COO(CH_2CH_2O)_{n3}H \quad \text{(III)}$$

wherein $R_3$ represents an alkyl group or an alkenyl group; and $n_3$ is 5 to 135.

8. The photographic light-sensitive material as claimed in claim 7, wherein R represents an alkyl group having 3 to 21 carbon atoms or an alkenyl group having 3 to 21 carbon atoms.

9. The photographic light-sensitive material as claimed in claim 1, wherein said nonionic surface active agent (i) is a nonionic surface active polyoxyethylene compound represented by the following general formula (IV):

$$R_4COO(CH_2CH_2O)_{n4}OCR_5 \quad \text{(IV)}$$

wherein $R_4$ and $R_5$, which may be the same of different, each represents an alkyl group; and $n_4$ is 5 to 100.

10. The photographic light-sensitive material as claimed in claim 9, wherein the total number of the carbon atoms in $R_4$ and $R_5$ is 6 to 34.

11. The photographic light-sensitive material as claimed in claim 1, wherein said nonionic surface active agent (i) is a nonionic surface active polyoxyethylene compound represented by the following general formula (V):

$$R_6O(CH_2CH_2O)_{n5}H \quad \text{(V)}$$

wherein $R_6$ represents an alkyl group or an alkenyl group which may be substituted with one or more fluorine atoms; and $n_5$ is 3 to 50.

12. The photographic light-sensitive material as claimed in claim 11, wherein $R_6$ represents an alkyl group having 4 to 22 carbon atoms or an alkenyl group having 4 to 22 carbon atoms.

13. The photographic light-sensitive material as claimed in claim 1, wherein said nonionic surface active agent (i) is a nonionic surface active polyoxyethylene compound represented by the following general formula (VI):

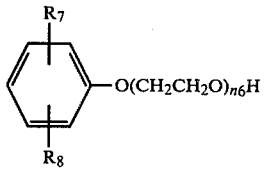

(VI)

wherein $R_7$ and $R_8$, which may be the same or different, each represents a hydrogen atom or an alkyl group which may be substituted with one or more fluorine atoms; and $n_6$ is 3 to 150.

14. The photographic light-sensitive material as claimed in claim 13, wherein $R_7$ and $R_8$ each represents an alkyl group having 1 to 9 carbon atoms.

15. The photographic light-sensitive material as claimed in claim 1, wherein said nonionic surface active agent (i) is a nonionic surface active polyoxyethylene compound represented by the following general formula (VII):

$$R_9-N\begin{matrix}(CH_2CH_2O)_pH\\(CH_2CH_2O)_qH\end{matrix} \quad \text{(VII)}$$

wherein $R_9$ represents an alkyl group; and p+q is 5 to 100.

16. The photographic light-sensitive material as claimed in claim 15, wherein $R_9$ represents an alkyl group having 8 to 18 carbon atoms or an alkenyl group having 8 to 18 carbon atoms.

17. The photographic light-sensitive material as claimed in claim 1, wherein said nonionic surface active agent (i) is a nonionic surface active polyoxyethylene compound represented by the following general formula (VIII):

$$R_{10}S(CH_2CH_2O)_{n7}H \quad \text{(VIII)}$$

wherein $R_{10}$ represents an alkyl group; and $n_7$ is 3 to 50.

18. The photographic light-sensitive material as claimed in claim 17, wherein $R_{10}$ represents an alkyl group having 4 to 18 carbon atoms.

19. The photographic light-sensitive material as claimed in claim 1, wherein said nonionic surface active agent (i) is a nonionic surface active polyoxyethylene compound represented by the following general formula (IX):

$$RfSO_2\underset{\underset{R_{11}}{|}}{N}(CH_2CH_2O)_{n8}H \quad \text{(IX)}$$

wherein Rf represents a perfluoroalkyl group; $R_{11}$ represents an alkyl group having up to 5 carbon atoms; and $n_8$ is 3 to 100.

20. The photographic light-sensitive material as claimed in claim 19, wherein Rf represents a perfluoroalkyl group having 3 to 12 carbon atoms.

21. The photographic light-sensitive material as claimed in claim 1, wherein said nonionic surface active agent (i) is a nonionic surface active polyoxyethylene compound represented by the following general formula (X):

$$R_{12}CON\begin{matrix}(CH_2CH_2O)_{p1}H\\(CH_2CH_2O)_{q1}H\end{matrix} \quad \text{(X)}$$

wherein $R_{12}$ represents an alkyl group or an alkenyl group; and $p_1+q_1$ is 3 to 100.

22. The photographic light-sensitive material as claimed in claim 21, wherein $R_{12}$ represents an alkyl group having 4 to 17 carbon atoms or an alkenyl group having 4 to 17 carbon atoms.

23. The photographic light-sensitive material as claimed in claim 2, wherein said nonionic surface active agent (i) is a nonionic surface active polyoxyethylene compound having the following repeating unit:

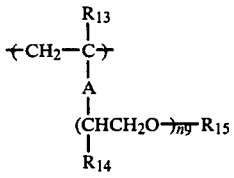

(XI)

wherein $R_{13}$ and $R_{14}$ represent a hydrogen atom or a methyl group; $R_{15}$ represents a hydrogen atom, an alkyl group, or an aryl group; A represents —COO— or

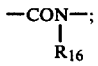

and $n_9$ is 1 to 50, $R_{16}$ representing a hydrogen atom or an alkyl group.

24. The photographic light-sensitive material as claimed in claim 23, wherein $R_{15}$ represents a hydrogen atom, an alkyl group having 1 to 5 carbon atoms or an aryl group having 7 to 12 carbon atoms.

25. The photographic light-sensitive material as claimed in claim 1, wherein the amount of the nonionic surface active agent (i) ranges from 5 to 500 mg/m$^2$, the amount of the anionic surface active agent (ii) ranges from 0.01 to 100 mg/m$^2$ and the amount of the anionic surface active agent (iii) ranges from 0.01 to 50 mg/m$^2$.

26. The photographic light-sensitive material as claimed in claim 23, wherein the amounts of the nonionic surface active agent and the anionic surface active agent range from 60 to 100 mg/m$^2$ and 0.1 to 30 mg/m$^2$, respectively.

27. The photographic light-sensitive material as claimed in claim 1, wherein the hydrophilic colloid of said hydrophilic colloid layer containing said nonionic surface active agent (i) and said anionic surface active agents (ii) and (iii) is gelatin.

28. The photographic light-sensitive material as claimed in claim 1, wherein said hydrophilic colloid layer containing said nonionic surface active agent (i) and said anionic surface active agents (ii) and (iii) is an outermost hydrophilic colloid layer.

29. The photographic light-sensitive material as claimed in claim 28, wherein said outermost hydrophilic colloid layer is a surface protective layer.

30. The photographic light-sensitive material as claimed in claim 28, wherein said outermost hydrophilic colloid layer is a backing layer.

31. The photographic light-sensitive material as claimed in claim 1, wherein said hydrophilic colloid layer further contains a hardening agent.

* * * * *